United States Patent [19]

Quinn et al.

[11] Patent Number: 5,007,280

[45] Date of Patent: Apr. 16, 1991

[54] TOOL HEAD FOR USE IN CRIMPING ELECTRICAL CONNECTORS

[75] Inventors: Robert L. Quinn, St. Petersburg; Frank Pansari, Jr., Clearwater, both of Fla.

[73] Assignee: Molex Incorporated, Lisle, Ill.

[21] Appl. No.: 470,671

[22] Filed: Jan. 26, 1990

[51] Int. Cl.[5] ..... H01R 43/04

[52] U.S. Cl. ..... 72/402; 72/407; 72/416; 29/753; 29/237

[58] Field of Search ..... 72/410, 409, 402, 416, 72/407; 29/751, 758, 237, 753

[56] References Cited

U.S. PATENT DOCUMENTS

| | | | |
|---|---|---|---|
| 2,878,698 | 3/1959 | Seurynck | 72/410 |
| 3,126,772 | 3/1964 | Haucke | 72/409 |
| 3,670,556 | 6/1972 | Kralowetz | 72/402 |
| 3,728,889 | 4/1973 | McIver | 72/410 |
| 3,931,726 | 1/1976 | Grubb | 29/753 |
| 4,261,194 | 4/1981 | Stephens | 72/402 |

FOREIGN PATENT DOCUMENTS

| | | | |
|---|---|---|---|
| 663186 | 5/1963 | Canada | 72/410 |
| 1035451 | 7/1958 | Fed. Rep. of Germany | 72/402 |
| 17857 | 7/1968 | Japan | 72/410 |

*Primary Examiner*—Daniel C. Crane

*Attorney, Agent, or Firm*—Louis A. Hecht; Stephen Z. Weiss; Charles S. Cohen

[57] ABSTRACT

A tool head for use in crimping a connector to a conductor, where the connector and conductor extend in a longitudinal direction. The tool head defines a crimping area about which a plurality of crimping nibs are mounted for movement into the crimping area so that the nibs act to indent the connector during a crimping operation of the tool head. Each nib is elongated and includes a connector indenting surface formed by a segment of a cylinder the axis of which extends transverse to the direction of elongation of the nib. In the preferred embodiment, four nibs are provided to define two opposing pairs of nibs. The nibs of one opposing pair are elongated generally transverse to the longitudinal direction of the connector, and the other opposing pair of nibs are elongated generally parallel to the longitudinal direction of the connector. Therefore, the nibs of each pair are elongated generally perpendicular to the nibs of the opposite pair.

15 Claims, 3 Drawing Sheets

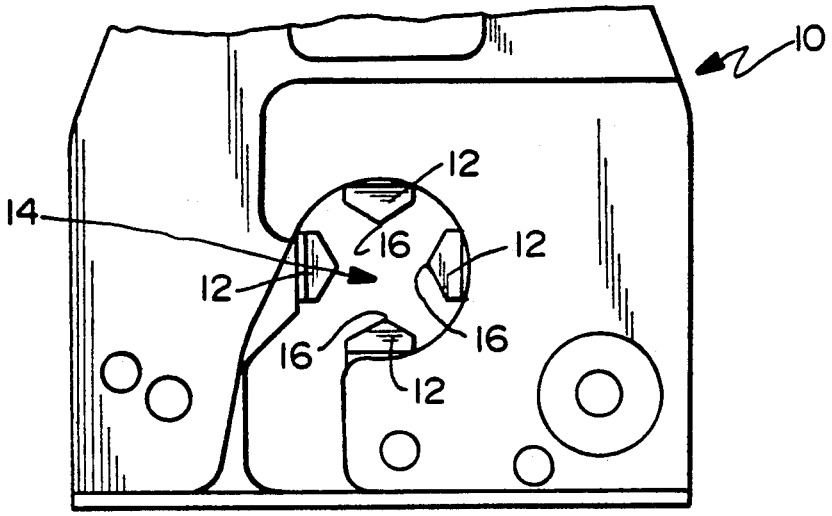
PRIOR ART FIG.1
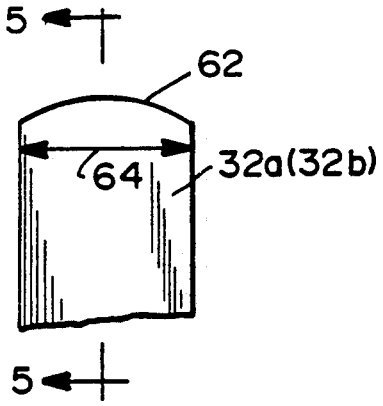
FIG.4
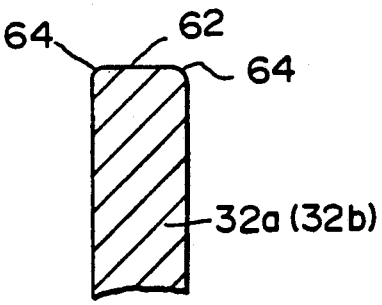
FIG.5

TOOL HEAD FOR USE IN CRIMPING ELECTRICAL CONNECTORS

FIELD OF THE INVENTION

This invention generally relates to compression tools and, particularly, to a tool head for use in crimping a connector to an electrical conductor.

BACKGROUND OF THE INVENTION

Compression tools are used in the electrical connector industry for compressing metal connectors about electrical conductors or between a conductor and a terminal. Usually, a conductor end is inserted into a receptacle portion of a connector, and the connector then is compressed onto the outside thereof by the compression tool to mechanically lock the connector to the conductor and, in some instances, to establish electrical conduction therebetween.

Such tools are used with many types of connectors such as ring tongue terminals, parallel splices, butt splices, and the like, which have a variety of configurations and sizes. Consequently, compression tools of the character described, whether manually, hydraulically or mechanically operated, usually include a tool head defining an enlarged crimping area about which indentors or nibs are disposed for closing movement into the area to engage and compress a properly positioned connector in order to effect a crimping action of the connector to the conductor. Usually, hydraulically operated tools function on regulated air pressure.

Heretofore, the tool heads of such compression tools have included indentors or nibs formed integrally with or attached to jaws for forcing the nibs inwardly to indent and crimp the connector. The nibs usually have indentor surfaces which are elongated generally parallel to the longitudinal direction of the connector and conductor. In addition, these nibs or indentor surfaces are relatively sharp. Examples of compression tool heads having this type of nib configuration are shown in U.S. Pat. Nos. 4,723,434, dated Feb. 9, 1988, and 4,480,460, dated. Nov. 6, 1984, to Bush. Commercial examples of similar nib configurations can be seen in tool models EP-630 and EP-630H of Huskie Tools, Inc.

However, such compression tool heads having nib configurations with sharp indentor surfaces running generally parallel to the connector and/or the conductor have been designed for use with metal connectors, such as for crimping copper and aluminum non-insulated parts. Crimping plastic and/or insulated parts requires completely different tool heads which have less severe nib configurations to avoid damaging the parts. It can be seen that this creates problems of requiring multiple tools and/or tool heads for a full range of electrical terminal operations of the type described above.

There is a definite need for a compression tool head of the character described which has indentor or nib configurations which can accommodate not only a wide range of connectors, terminals, conductor sizes and the like, but which can be used with both metal, plastic, non-insulated and insulated terminals, splices and the like. This invention is directed to providing a compression tool with a tool head having indentor or nib configurations which solve the above problems and satisfy the stated need.

SUMMARY OF THE INVENTION

An object, therefore, of the invention is to provide a new and improved tool head for use in crimping a connector to a conductor, generally where the connector and conductor extend in a longitudinal direction.

In the exemplary embodiment of the invention, the tool head has a crimping area into which the connector, preliminarily attached to a conductor, can be positioned. A plurality of crimping nibs are mounted, such as on appropriate jaws, for movement into the crimping area so that the crimping nibs act to indent the connector during a crimping operation of the tool head. At least one of the crimping nibs is elongated generally transverse to the longitudinal direction of the connector and another of the crimping nibs is elongated generally parallel to that longitudinal direction.

As disclosed herein, four crimping nibs are movable into the crimping area at equidistant angular positions thereabout. The crimping nibs of one opposing pair thereof are elongated generally transverse to the longitudinal direction of the connector, and the crimping nibs of another opposing pair thereof are elongated generally parallel to the longitudinal direction, i.e., generally perpendicular to the one opposing pair.

Each crimping nib has a connector indenting surface convexly radiused on an axis generally perpendicular to the direction of elongation of the nib. In addition, each crimping nib is generally flat on any line extending generally transverse to the direction of elongation of the nib. In other words, the connector indenting surface of each crimping nib is formed like a segment of a cylinder.

Other objects and features of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a fragmented elevational view of a compression tool head incorporating crimping nibs according to the prior art;

FIG. 4 is an elevational view, on an enlarged scale, of one of the crimping nibs of the invention; and FIG. 5 is a section taken generally along line 5—5 of FIG. 4.

DETAILED DESCRIPTION OF THE PREFERRED EMBODIMENT

Figure 2:
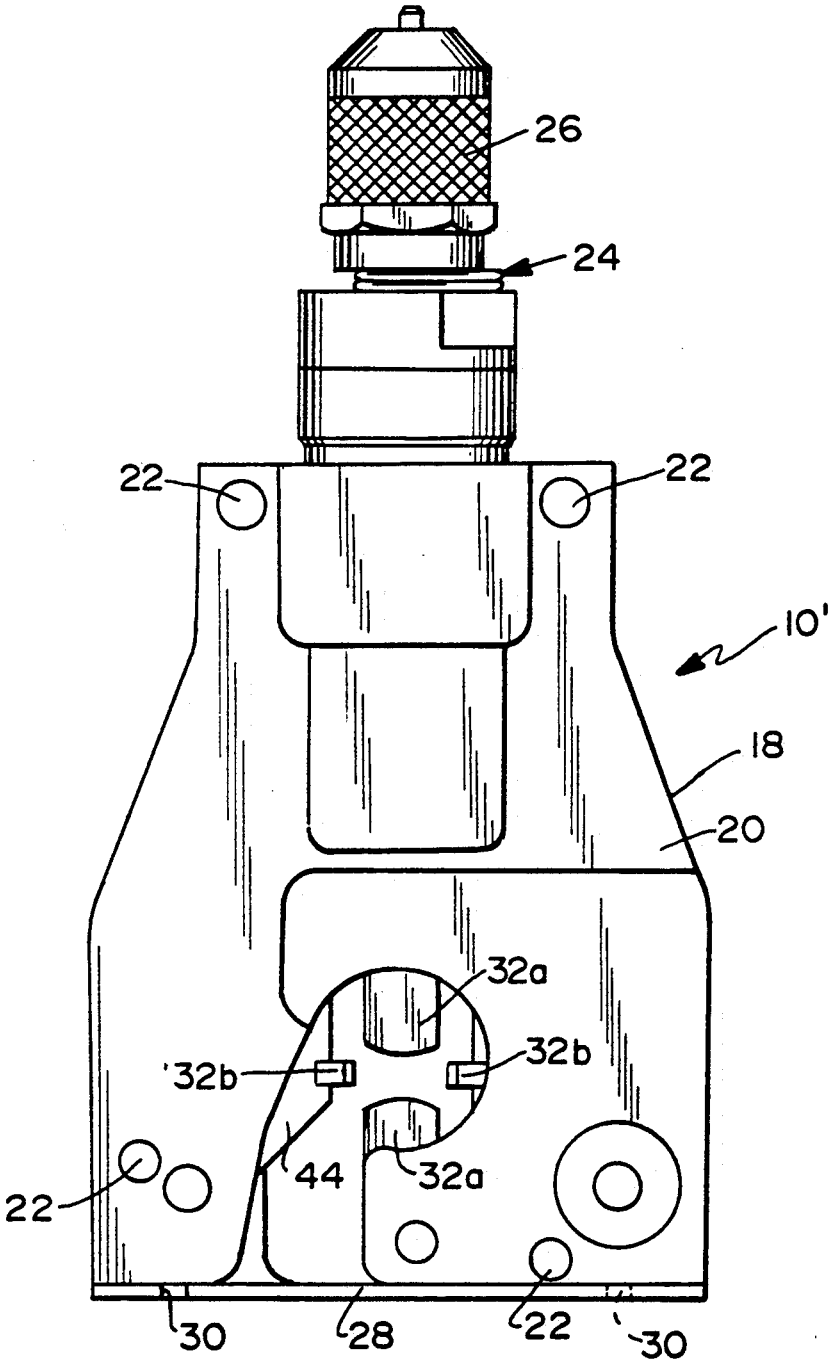
FIG. 2, is an elevational view of a compression tool head embodying crimping nibs according to the invention.

Referring to the drawings in greater detail, and first to FIG. 1, the lower portion of a tool head, generally designated 10, is illustrated to show the use of a plurality of crimping nibs 12 configured according to the predominant teachings of the prior art. It can be seen that four crimping nibs 12 are disposed about an open crimping area, generally designated 14, and into which nibs 12 move to act on and indent an appropriate connector positioned in area 14. This will be more apparent hereinafter when describing FIGS. 2 and 3 in greater detail.

Suffice it to say, it can be seen that each nib 12 has an indenting surface 16 which is generally sharp and elongated in a direction generally parallel to a longitudinal direction of an appropriate connector and its conductor. In other words, a connector, preliminarily attached to a conductor, usually at an end of the conductor, is positioned in crimping area 14 in a direction perpendicular to the depiction of the drawing, as is well known in the art. As used herein and in the claims hereof, this is what is referred to as the longitudinal direction of the connector and the conductor.

Such nib configurations of the prior art as depicted in FIG. 1 are predominantly used primarily with metal connectors, such as in crimping copper and aluminum non-insulated parts. The nibs effect longitudinal indentations which diverge into the connector to tightly crimp the connector onto the conductor along lines generally parallel thereto.

It should be understood herein and in the claims hereof that the term "connector" is not being used in any way in a limiting sense, such as merely connoting a part to connect a conductor to a device, but the term is being used in a broad sense to mean any part which can be appropriately crimped to a conductor by the disclosed tool head.

FIG. 2 shows a tool head, generally designated 10', which includes a housing 18 having a housing cover 20 secured to the housing by appropriate fasteners 22. A piston-and-cylinder device, generally designated 24, is secured to housing 18 and cover 20 and includes a hydraulic coupling 26 for coupling the piston-and-cylinder device to a hose suitable for hydraulic fluid and pressure, with a mating coupling, which is connected to a hydraulic pumping unit and reservoir. Housing 18 includes a base flange 28 having appropriate apertures 30 for securing the tool head to an appropriate subjacent support surface, such as the top of a work bench.

FIG. 2 shows four crimping nibs **32*a* and 32*b* spaced equidistant angularly about crimping area 14. Nibs 32*a* form one opposing pair of crimping nibs, and nibs 32*b* form another or second opposing pair of crimping nibs. It can be seen in FIG. 2, as well as the remaining figures described hereinafter, that nibs 32*a* are elongated generally transverse to the aforesaid longitudinal direction of the connector and/or conductor. Nibs 32*b* are elongated generally parallel to the longitudinal direction of the connector. In other words, one opposing pair of nibs 32*a* are elongated generally perpendicular to the other pair of nibs 32*b***. This alternating orientation of the nibs provide better integrity to the composite connector crimp because the crimping stresses are not all in the same direction. This alternating orientation facilitates use of the tool with both metal and softer plastic parts as well as with non-insulated and softer insulated parts. Still further, by providing a composite crimp of more uniform stress orientation, better integrity for the crimp is afforded with multi-stranded conductors. Preferably, when crimping such conductors, it is most desirable to avoid disturbing the strand configuration. With the prior art, wherein the crimping nibs all extend in the same longitudinal direction of the conductor, the configuration of the conductor strands often is disturbed severly. The invention greatly reduces this disturbance.

Figure 3:
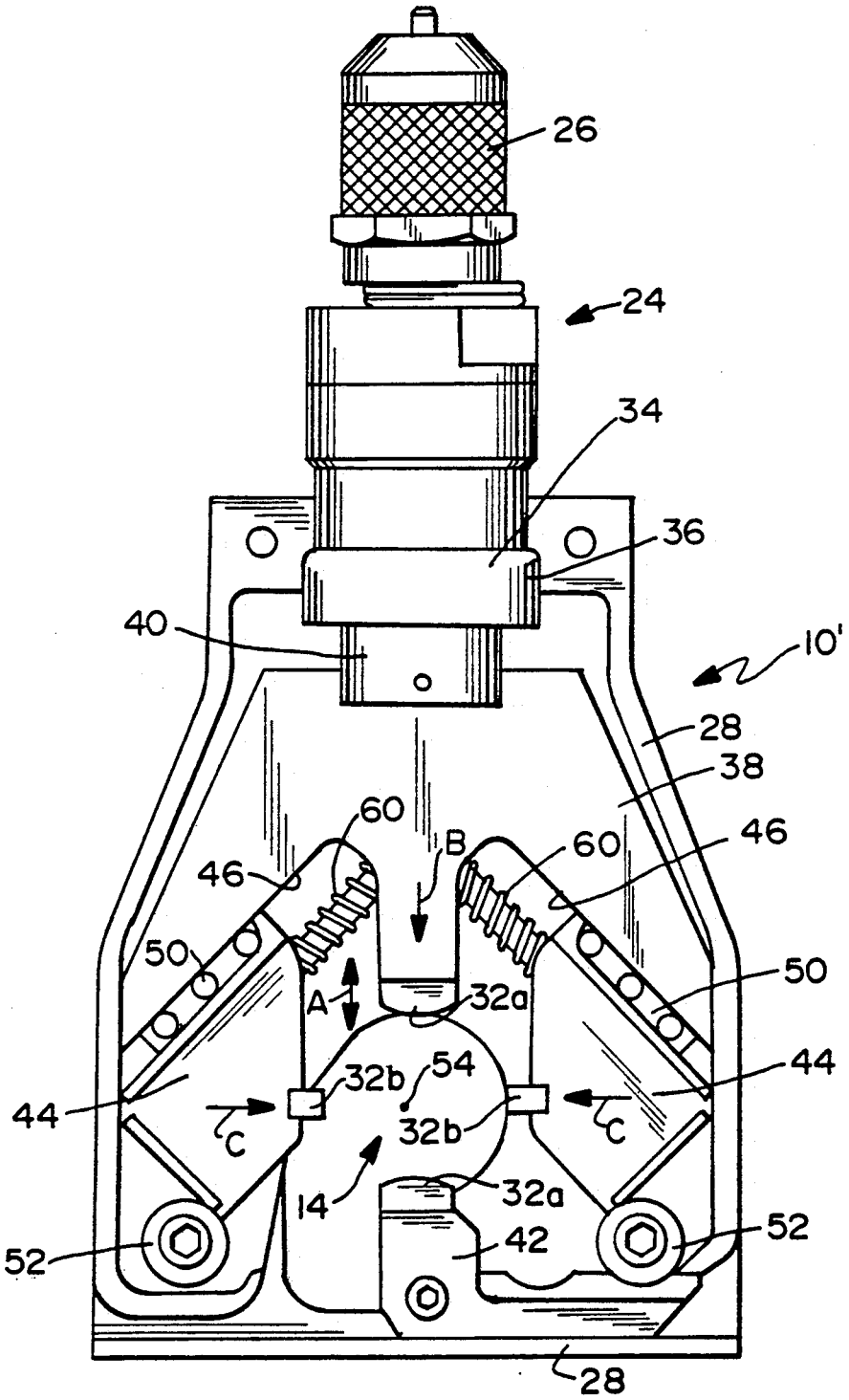
FIG. 3, is an elevational view of the tool head of FIG. 2, with the housing cover removed to show the interior components,/thereof.

FIG. 3 shows tool head 10' with cover 20 removed to illustrate the interior components of the head. It should be understood that this general arrangement, as described hereinafter, is generally conventional and will not be described in great detail.

Suffice it to say, piston-and-cylinder device 24 has an enlarged flange portion 34 which is captured in a recess 36 in housing 28. A similar, mating recess is provided on the inside of cover 20 so that when the cover is attached to housing 28 by fasteners 22, the piston-and-cylinder device is secured.

Nibs **32*a*, 32*b* are attached to (integral with as shown herein) four jaws which are effective to move the nibs relative to each other in a closing action toward the center of crimping area 14 to effect indentation or crimping of an appropriate connector. More particularly, a main jaw 38 is fixed to piston 40 of piston-and-cylinder device 24 so that the jaw moves in the direction of double-headed arrow A. An opposing jaw 42 is fixed to the top of flange 28. Movable main jaw 38 and fixed jaw 42 support nibs 32*a*. A pair of identical, movable side jaws 44 are mounted to oblique surfaces 46 of main jaw 38 by sliding connections 50. Movable jaws 44 also engage roller bearings 52. The movable jaws support crimping nibs 32*b***.

It can be seen in FIG. 3 that all of the jaws support the nibs in position directly radially outwardly of a center point 54 of crimping area 14. With this known type of tool head, it can be understood that when piston 40 of piston-and-cylinder device 24 moves downwardly in the direction of arrow "B", oblique surfaces 46 and sliding connections 50 will cause movable jaws 44 to move inwardly in the direction of arrows "C". This action of jaw 38 moves upper nib **32*a* toward lower, fixed nib 32*a*, and moves the opposite pair of nibs 32*b* inwardly toward each other, where both pairs of nibs 32*a* and 32*b* move conjointly toward center point 54 of crimping area 14, it being understood that the center point varies in position relative to crimping area 14, depending on the diameter of the connector being crimped, because jaw 42 is stationary. On the reverse stroke of jaw 38 upwardly, i.e., opposite the direction of arrow "B", spring devices 60 are effective to bias movable side jaws 44 back outwardly opposite the direction of arrows "C" to ready the tool head for a subsequent crimping operation. Pulsation and control of air to piston-and-cylinder device 24** is effected by known controls.

FIG. 3 also shows the alternating orientation of the elongated configurations of the opposing pairs of nibs **32*a* and 32*b***, respectively.

FIGS. 4 and 5 show in greater detail the configuration of each nibs **32*a* and 32*b*. It can be seen that the actual connector indenting surface 62 (FIG. 4) of each nib is convexly radiused on an axis generally perpendicular to the direction of elongation of the nib, the direction of elongation being represented by double-headed arrow line 64. As with the alternating orientation of the opposing pairs of nibs as described in relation to FIGS. 2 and 3**, this radiused surface more evenly distributes the crimping or indenting forces than the crimping configurations of the prior art. Again, this allows the tool head to be used with plastic and insulated parts as well as with metal and noninsulated parts.

Furthermore, FIG. 5 shows that indenting surface 62 is generally flat along any line generally transverse to the direction of elongation of the nib, i.e., as represented by the top straight line of the nib in FIG. 5 which is a section transversely through the nib as depicted in the elongated depiction of FIG. 4. In other words, indenting surface 62 actually comprises a segment of a cylinder. By flattening the surface, there is much less tendency for the nib to cut or score a plastic part or to cut through an insulated part. Of course, the corners of the nib, as at 64, should be on a radius also to prevent cutting and scoring.

Although each of the features of the nib configuration of the invention, i.e., the alternating orientation of the nibs, the convexly radiused nib surfaces and the flattening of the nibs is effective to expand the use of the tool head from metal and non-insulated parts to plastic and insulated parts, the combination of these three features further enhance the versatility and universality of the tool head.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a tool head for use in crimping a connector to a conductor comprising means defining a crimping area of the tool head into which the connector and conductor extend in a longitudinal direction, at least three crimping nibs mounted around said crimping area, each said nib having a connector crimping face and being mounted for radial movement relative to said connector so that a portion of each said face acts to crimp said connector to secure said connector to said conductor during a crimping operation of the tool head, each said nib being mounted in said crimping area of said tool head so that the connector is crimped at spaced points located generally about the circumference of the connector, the improvement comprising:

first and second nibs having substantially identical connector crimping faces each defined by a major dimension and a minor dimension, said major dimension being larger than said minor dimension, and wherein said first nib is oriented such that said minor dimension is generally parallel to said longitudinal direction and said second nib is oriented such that said minor dimension is generally perpendicular to said longitudinal direction.

2. The improvement of claim 1 wherein the connector crimping face of each of said first and second nibs is generally curved about an axis parallel to its minor dimension.

3. The improvement of claim 2 wherein said first and second lines are generally adjacent to each other.

4. The improvement of claim 2 wherein each said curved connector crimping face is generally flat along any line parallel to its minor dimension.

5. In a crimping tool comprising a housing, a tool head for crimping a connector to a conductor, means defining a crimping area of the tool head into which the connector and conductor extend in a longitudinal direction, first and second generally opposed pairs of crimping nibs mounted around said crimping area for radial movement relative to said connector, each nib having a contact face of which a portion thereof acts to crimp said connector to secure said connector to said conductor during a crimping operation of said crimping tool, and hydraulic means associated with said crimping nibs causing said nibs to crimp said connector, each said nib being mounted in said crimping area of said tool head so that the connector is crimped at spaced points located about the periphery of the connector, the improvement comprising:

the contact face of each said nib being defined by a major dimension and a minor dimension, said major dimension being greater than said minor dimension, and wherein the first pair of nibs is oriented such that the major dimension of each nib is generally parallel to said longitudinal direction and the second pair of nibs is oriented such that the major dimension of each nib is generally perpendicular to said longitudinal direction.

6. The improvement of claim 5 wherein the contact face of each said nib is generally curved about an axis parallel to its minor dimension.

7. The improvement of claim 6 wherein one of said nibs is fixed relative to said housing.

8. The improvement of claim 7 wherein each of said curved contact faces is generally flat along any line parallel to its minor dimension.

9. In a tool head for use in crimping a connector to a conductor comprising means defining a crimping area of the tool head into which the connector and conductor extend in a predetermined direction, first and second generally radially opposed pairs of crimping nibs mounted around said crimping area, each said nib having a connector crimping face and being mounted for radial movement relative to said connector so that a portion of each said connector crimping face contacts said connector to deform the connector to secure said connector to said conductor during a crimping operation of the tool head, each said nib being mounted in said crimping area of said tool head so that the connector is crimped at spaced points located about the periphery of the connector, the improvement comprising:

the connector crimping face of each nib extending generally along a major axis and a minor axis, said face having a greater dimension along said major axis than along said minor axis, and wherein the major axis of each said nib of said first pair is perpendicular to the major axis of each said nib of said second pair.

10. The improvement of claim 9 wherein the connector crimping face of each of said nibs is generally curved about an axis parallel to its minor axis.

11. The improvement of claim 10 wherein each said curved connector crimping face is generally flat along any line parallel to its minor axis.

12. The improvement of claim 10 wherein one of said nibs is fixed relative to said tool head.

13. The improvement of claim 12 wherein the connector crimping face of each of said nibs of said first and second pairs is generally curved about an axis parallel to its minor dimension.

14. The improvement of claim 13 wherein each of said curved connector crimping faces is generally flat along any line parallel to its minor dimension.

15. In a tool head for use in crimping a connector to a conductor comprising means defining a crimping area of the tool head into which the connector and conductor extend in a longitudinal direction, first and second generally radially opposed pairs of crimping nibs mounted around said crimping area, each said nib having a connector crimping face and being mounted for radial movement relative to said connector so that a portion of each said face acts to crimp said connector to secure said connector to said conductor during a crimping operation of the tool head, each said nib being mounted in said crimping area of said tool head so that the connector is crimped at spaced points located about the periphery of the connector, the improvement comprising:

each nib of said pairs having a connector crimping face defined by a major dimension and a minor dimension, said major dimension being greater than said minor dimension, and wherein the first pair of nibs is oriented such that the minor dimension of each nib is generally parallel to said longitudinal direction and the second pair of nibs is oriented such that the minor dimension of each nib is generally perpendicular to said longitudinal direction.

* * * * *